US005207050A

United States Patent [19]

Fulkerson et al.

[11] Patent Number: 5,207,050

[45] Date of Patent: May 4, 1993

[54] APPARATUS AND METHOD FOR ASSEMBLING COMPACT DISC OR MEDIA PACKAGE

[75] Inventors: Greg Fulkerson, Maple Plain; Peter N. Y. Pan, Minnetonka; Stephen Kaye, Eden Prairie, all of Minn.

[73] Assignee: Thiele Engineering Company, Minneapolis, Minn.

[21] Appl. No.: 820,846

[22] Filed: Jan. 15, 1992

[51] Int. Cl.[5] ..... B65B 61/20; B65B 5/12

[52] U.S. Cl. ..... 53/474; 53/157; 53/238; 53/251; 53/254

[58] Field of Search ..... 53/474, 468, 157, 155, 53/254, 238, 240, 251, 250, 249, 234, 169; 206/313, 312, 309; 29/775, 773

[56] References Cited

U.S. PATENT DOCUMENTS

| | | | |
|---|---|---|---|
| 4,150,520 | 4/1979 | Palmieri et al. | 53/234 X |
| 4,428,014 | 1/1984 | Saito | 360/133 |
| 4,551,966 | 11/1985 | Aoyagi et al. | 53/254 X |
| 4,685,277 | 8/1987 | Ilsemann | 53/254 X |
| 4,852,327 | 8/1989 | Kurkowski et al. | 53/254 X |
| 4,881,356 | 11/1989 | Beezer et al. | 53/238 X |
| 4,925,023 | 5/1990 | Goldblatt et al. | 206/309 |
| 4,993,552 | 2/1991 | Bugbey et al. | 206/444 |
| 4,998,618 | 3/1991 | Borgions | 206/307 |

OTHER PUBLICATIONS

"Semi-Automatic Rotary Assembly Table-Operation and Maintenance Manual", Ivy Hill Corp., Serial No. 7051, (no date).

*Primary Examiner*—James F. Coan
*Attorney, Agent, or Firm*—Hugh D. Jaeger

[57] ABSTRACT

Process and apparatus for assembly of an ecologically compact disc or media package where a trayed rotating table advances to process a packaging sleeve and place a compact disc or media package on a processed packaging sleeve. A packaging sleeve is placed in a tray on one rotating table and subsequently a pamphlet is glued to the packaging sleeve. A one-piece compact disc or media base on another rotating table is placed on the awaiting packaging sleeve. An end cap can then be separated from the base. The packaging sleeve is secured by glue to the compact disc or media base and end cap. The end cap is either cut away or manually separated from the media base.

2 Claims, 2 Drawing Sheets

APPARATUS AND METHOD FOR ASSEMBLING COMPACT DISC OR MEDIA PACKAGE

BACKGROUND OF THE INVENTION

1. Field of the Invention

The present invention relates to apparatus for assembling a package to be used in displaying a compact disc or other media at a point of sale in stores, and for later storage in the home. The present invention also includes a process for assembly of the media package. Other media packages includes CD, ROMs, Optical ROMs, cassette tapes, laser discs or video tapes.

2. Description of the Prior Art

Compact discs ("CD") have become the medium of choice for recorded music. The compact discs have also presented packaging difficulties. A CD package has been needed which is large enough to provide adequate surface area for advertising in retail establishments, and which is large enough to discourage shoplifting.

The packaging must also be usable in the home or elsewhere for storage of the compact disc. Of course, the packaging for home storage is preferably no larger than needed to adequately store the compact disc.

In the prior art, this resulted in one storage package, such as a jewel box, for the home being overwrapped with additional disposable material to constitute the retail package. The hinged storage box is referred to as a jewel box and was usually a polymer of polystyrene which was very scratchable and very difficult to recycle. This large retail package and/or packaging was immediately thrown away by the customer, and then moved into the solid waste stream. CD packages were needed which could perform the two functions of retail display and home storage without immediately generating large amounts of solid waste. An additional problem was that the outside retail package was often made of non-biodegradable plastic and was not environmentally appropriate, especially to recycle.

The succeeding generation of compact disc packages was formed from a long rectangle of paper material, such as cardboard. A plastic compact disc holder was mounted to the cardboard. The cardboard and plastic holder had one configuration for store display and is known as a DigiPak. After purchase, the customer reconfigured the plastic holder and folded the cardboard to reconfigure the package to a smaller size for home use. Therefore, none of the package was immediately thrown away. Additionally, the package could be made to employ more biodegradable paper products and olefin type polymers which are more easily recycled. This form of package posed new problems for compact disc loading on the CD package.

The present invention is an apparatus which can quickly and efficiently assemble the plastic parts to the paper parts to create a modern style package configuration, known as an EcoPak. As new formats of recording media are introduced, such as mini discs, this style of packaging will be adapted to the various sizes for CD, ROMs, laser discs, audio tapes and even video tapes. Additionally, the present invention embodies other material disc holders besides plastic as such materials become available.

SUMMARY OF THE INVENTION

The general purpose of the present invention is to provide a generally circular table which rotates through a series of positions, including a plurality of trays mounted on the table for assembling an EcoPak package. The components are currently manufactured by Ivy Hill as attached hereto as Exhibit A. Such components can be manufactured by others in the future. Each tray is generally rectangular, and is mounted with its longest axis on a radius of the circle. Trays are preferably mounted spaced apart by equal angles around the table.

According to one embodiment of the present invention, there is provided apparatus for loading an album sheet or sleeve on a tray in a first position. The table is rotated to a disc frame loading position. As the table is rotating to the disc frame loading position, glue is applied to the sleeve. Structure is then provided for mounting a disc frame on the sleeve at the disc frame loading position. The table is then rotated to an unload position where structure is provided for removing the assembled sleeve and disc frame.

In another embodiment, an intermediate pamphlet position is provided. Glue is applied to the sleeve, and a pamphlet is mounted on the sleeve. A pamphlet can then be inserted into the sleeve.

In further embodiments, structure is provided for cutting or breaking an end cap from disc frames designed to have a removable end cap.

One significant aspect and feature of the present invention is the forming of an EcoPak package for compact disc sale and later storage.

Another significant aspect and feature of the present invention is an assembly of a package for media which is in a first configuration for display such as at a point of sale and can be folded into a second configuration for storage of the media.

Having thus described the embodiments of the present invention, it is a principal object hereof to provide an apparatus for assembling an EcoPak package to be used in displaying compact discs or other media in stores, and for later storing of them in the home.

One object of the present invention is an assembly machine for an environmentally compact disc or media package which is self-supporting in structure on a store shelf and later foldable for consumer storage.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
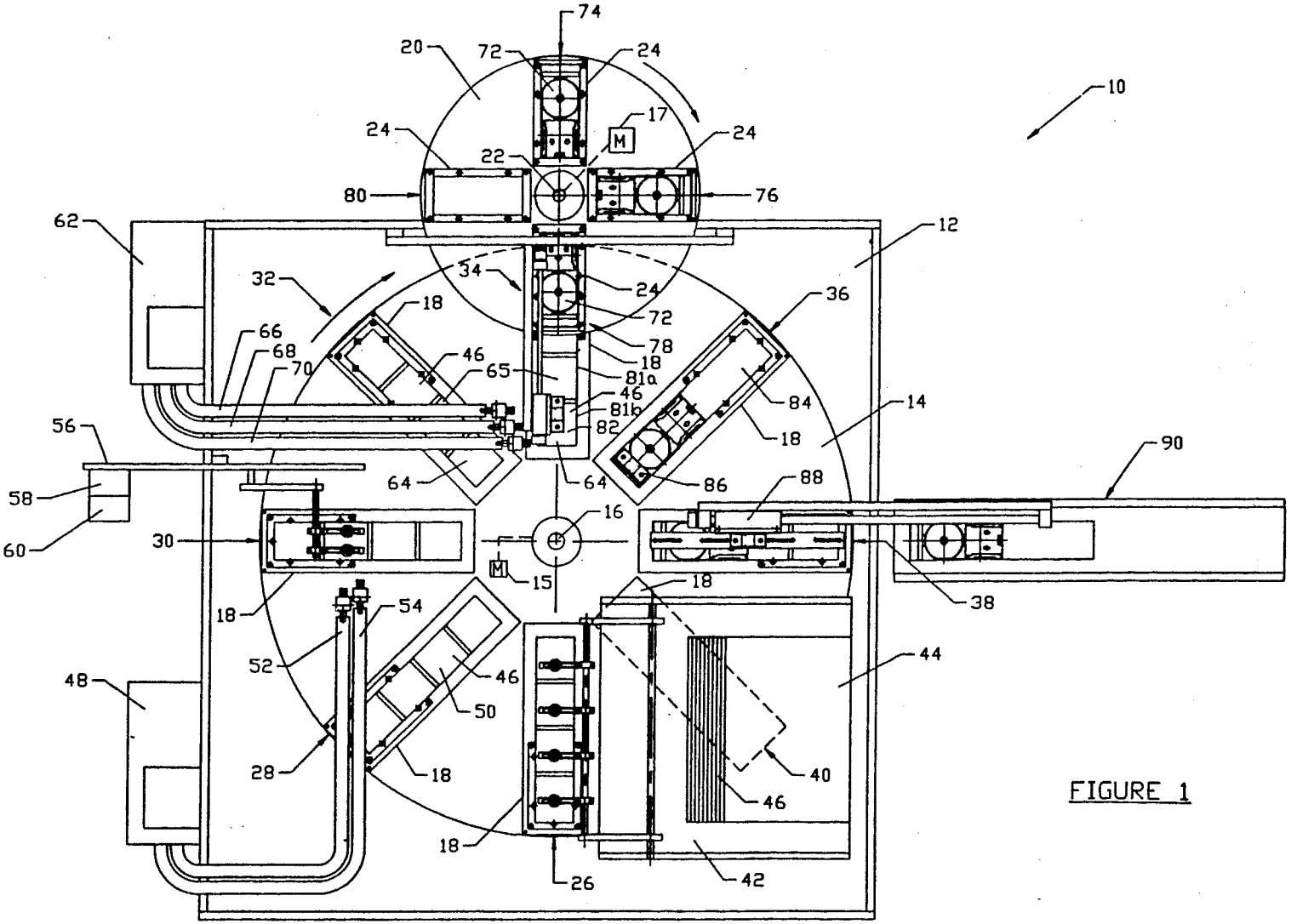
FIG. 1 illustrates a top plan view of a compact disc or media package assembler constructed according to the present invention; and, FIG. 2 illustrates a top plan view of a second embodiment of the compact disc or media package assembler in which pamphlets are slid into sleeves, rather than glued onto a cardboard base.

FIG. 1 illustrates a compact disc or media package assembly system 10 including various components mounted on a base 12 as now described in detail. A generally circular first rotary table 14 driven by a stepper motor 15 rotates about a central post 16, and includes a plurality of like trays 18. A generally circular second smaller rotary table 20 is elevated above the plane of the first rotary table 14, and is rotationally driven by a stepper motor 17 about a central post 22 and includes a plurality of like trays 24. The trays 18 and 24 are generally rectangular, and are formed to accurately position an album or sleeve, and accept and accurately position a compact disc base plate. The trays 18 and 24 are generally aligned along the radii of tables 14 and 20, respectively. The trays 18 are spaced about first rotary table 14, separated by generally equal angles. Similarly, trays 24 are spaced about the second rotary table 20 in an equal angular fashion. In the illustrated embodiment, the trays 18 on the first rotary table 14 are radially spaced at 45° from each other, and the trays 24 on the second rotary table 20 are radially spaced from each other at 90°. These spacings are for purposes of example and illustration only, and are not to be construed as limiting of the scope of the present invention.

The trays 18 are advanced as the first rotary table 14 rotates through positions 26–40. Each successive tray 24 of the second rotary table 20 aligns with each successive tray 18 of the first rotary table 14 as each rotary table 14 and 20 is advanced about its respective central post 16 and 22. A rotary placer 42, including a hopper 44 for album sheets or sleeves 46, secures to the base 12 and aligns over and about the first rotary table 14. The rotary placer 42 aligns with one tray 18 in position 26 in the illustrated embodiment. Album sleeves 46 are preferably sheets of cardboard or other paper product or like product which can be stacked in hopper 44. The rotary placer 42 is preferably a standard literature placer which picks up sheets with a vacuum head and places the sheets in the tray 18. However, those skilled in the art may use any other suitable type of known paper or like placer for this activity. Should materials other than paper products be chosen for a sleeve, those skilled in the art may easily adopt the present invention to a suitable placer for the chosen sleeve material.

Individual album sleeves 46 are placed by the rotary placer 42 into the aligned tray 18 at position 26. After sleeve loading at position 26, the tray 18 is advanced to position 28 and subsequently to position 30. The placed album sleeve 46 is mechanically aligned in position 28 using a plunger mechanism to assure alignment of the album sleeve 46 in the tray 18 against preformed tray stops. As the tray 18 with album sleeve 46 is advanced between position 28 and 30, a first glue machine 48 dispenses glue to one panel 50 of the album sleeve 46 through glue tubes 52 and 54.

A reciprocating placer 56 with a pamphlet feeder 58, holding a plurality of pamphlets 60, aligns with tray 18 at position 30 to place one pamphlet 60 on the glue-laden panel 50 of the album sleeve 46 to secure the pamphlet 60 to the album sleeve 46.

The tray 18 with album sleeve 46 is then advanced to position 32, and the album sleeve 46 is centered in the tray 18. The tray 18 is then advanced to position 34. A second glue machine 62 applies glue to panel 64 of the album sleeve 46 through glue tubes 66, 68, and 70 as the tray 18 advances from position 32 to position 34. The centered and glue-laden album sleeve 46 in tray 18 at position 34 is now ready to receive a compact disc base and end cap 72 from the second rotary table 20.

The appropriate tray 24 of the second rotary table 20 is loaded at position 74 with a compact disc base 72. Tray 24 may be loaded by hand or by actuated loading equipment. The second rotary table 20 is advanced through positions 74–80. The compact disk base and end ca 72 at position 78 is aligned and positioned in an upper die half **81*a* of matching tray dies 81*a*–81*b* by vacuum. The upper matching die tray half 81*a* is attached to a loader 82 which transports the compact disc base and end cap 72 and places such on panels 64 and 65 of the album sleeve 46 at position 34. On placement, the upper and lower matching dies 81*a* and 81*b* mate to automatically and accurately position and align the compact disc base and end cap 72 on the album sleeve 46 residing in the tray 18 at position 34. The tray 18 with the accurately placed and glued-on pamphlet 60 and glued-on compact disc base 72 is then advanced to position 36**.

An optional cutter device 84 at position 36 cuts, severs, snaps, or otherwise separates an end cap 86 from the main body of the compact disc base 72. In lieu of the optional cutter, the end cap 86 can be manually separated from the main body. End cap 86 remains glued to sleeve 46. The first rotary table 14 then advances the tray 18, with assembled sleeve 46, pamphlet 60, and compact disc base 72 at position 36 to position 38. A placer 88 then moves the assembled product from the tray 18 to a conveyor 90. The assembled product can also be manually removed. The tray 18 is then advanced in an empty state from position 38 to position 40 and then to position 26 where another pamphlet 60 is loaded therein. Placers 82 and 88 are suitable industrial assembly line placer devices. Those skilled in the art may select from readily available placement equipment for these parts of the compact disc package assembly system 10. Of significance is matched upper and lower dies **81*a* and 81*b*** which are floating and self-seating in order to obtain an accuracy of +0, −5 mils in position of the plastic tray relative to the sleeve cut edge so as to snap together when assembled.

Figure 2:
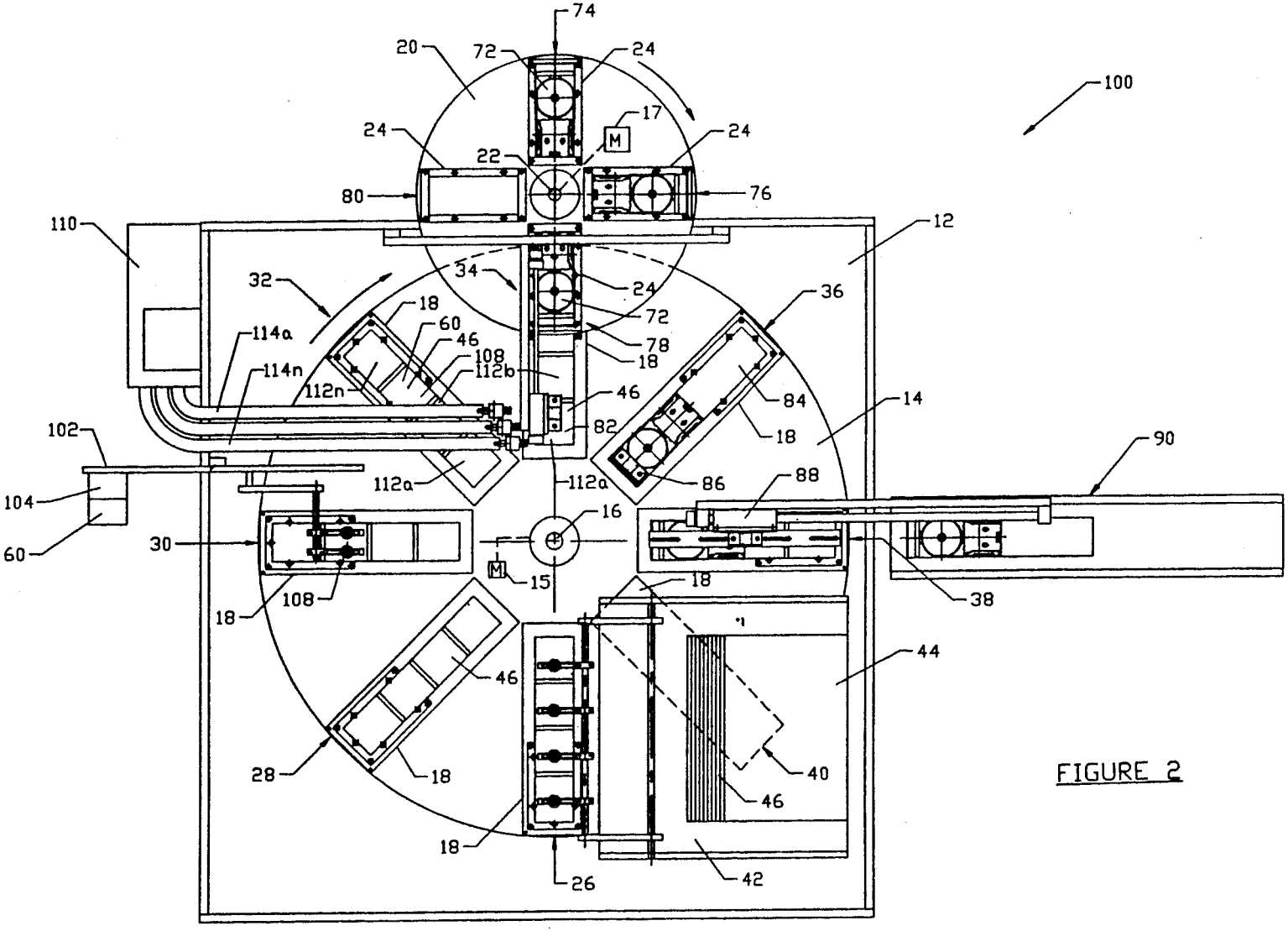

FIG. 2 illustrates an alternative embodiment of a compact disc or media package assembly system 100 where all numerals correspond to those elements previously described. This embodiment is for album sleeves 46 and is not designed for glued pamphlets. A reciprocating placer 102 with a pamphlet feeder 104 holding a plurality of pamphlets 60 aligns with a tray 18 at position 30. Placer 102 inserts a pamphlet 60 into a pocket 108 of the album sleeve 46. Reciprocating placer 102 is a standard literature placer which picks literature in a reciprocating fashion and inserts it in position.

A glue machine 110 applies glue to the appropriate panels **112*a*–112*n* of the album sleeve 46 through a plurality of glue tubes 114*a*–114*n* as the tray 18 advances from position 32 to position 34. Compact disc bases 72 at position 78 are transported by the placer 82 and placed on panels 112*a* and 112*b* or other panels of the album sleeve 46 as required at position 34**.

MODE OF OPERATION

Folders are placed on the main assembly table by a reciprocating placer. Trays are placed on the hand-load table by the operator which can also be semi-automated or automated. As the table indexes, glue is applied to the folder. A transfer placer functions to transfer the trays from the hand-load table to the folder with glue. A knife cuts the tray at the scoreline, and the assembled folder with tray is then discharged from the machine.

Various modifications can be made to the present invention without departing from the apparent scope hereof.

We claim:

1. Process for assembling an ecologically compact disc or media package comprising the steps of:

a. rotating a table with a plurality of spaced trays through predetermined positions;

b. placing a cardboard with a plurality of panels into a tray at a first position;

c. rotating the table to a second position, in which the cardboard is properly aligned and positioned;

c. applying glue and placing a pamphlet on the cardboard at a third position;

e. rotating the table to a further position;

f. applying glue to the cardboard and placing a compact disc base with an end cap on the glue;

g. cutting the end cap from the compact disc base; and, h. lifting the cardboard with the compact disc base and end cap off the table.

2. Apparatus for assembling a compact disc package, comprising:

a. a generally circular rotatable table;

b. a plurality of sleeve trays mounted on said table, each of said trays being aligned generally on a radius of said table, and said trays being generally equally radial spaced around said table;

c. means for rotating said table to move said trays to a series of predetermined positions;

d. means for loading an album sleeve onto one of said trays at a first position;

e. means for applying glue to the album sleeve before said sleeve reaches a second position;

f. a second generally circular rotatable table;

g. a plurality of media trays mounted on the table, each tray being mounted on a radius of said table and spaced equally radially around said table;

h. means for rotating the second table through a series of predetermined positions, one of the predetermined positions aligning with said media placement position of said first table;

i. a placer for moving media bases from said media base trays on said second table to the album sleeve on said first table; and, j. means for removing said assembled sleeve and media base from the tray.

* * * * *